US005461881A

United States Patent [19]

Handel et al.

[11] Patent Number: 5,461,881

[45] Date of Patent: Oct. 31, 1995

[54] ARRANGEMENT FOR DRIVING A WARP BEAM

[75] Inventors: Ulrich Handel, Albstadt; Joachim Kirchner, Mainhausen, both of Germany

[73] Assignee: Karl Mayer Textilmashinenfabrik GmbH, Obertshausen, Germany

[21] Appl. No.: 293,701

[22] Filed: Aug. 22, 1994

[30] Foreign Application Priority Data

Aug. 27, 1993 [DE] Germany ..... 43 28 814.6

[51] Int. Cl.[6] ..... D04B 27/20; D02H 13/12; D03D 49/10

[52] U.S. Cl. ..... 66/210; 139/100; 139/105; 242/420.5; 242/564

[58] Field of Search ..... 66/210, 212; 28/193, 28/194; 139/100, 105, 35.5 R; 242/420.5, 563, 564, 36

[56] References Cited

U.S. PATENT DOCUMENTS

| | | | |
|---|---|---|---|
| 3,221,519 | 12/1965 | Bassist . | |
| 4,519,039 | 5/1985 | Surana et al. | 242/420.5 X |
| 5,375,435 | 12/1994 | Gille et al. | 66/210 X |

FOREIGN PATENT DOCUMENTS

| | | | |
|---|---|---|---|
| 31111112 | 10/1982 | Germany . | |
| 3219132 | 12/1983 | Germany . | |
| 2163265 | 6/1990 | Japan | 242/420.5 |
| 0821576 | 4/1981 | U.S.S.R. | 66/212 |
| 0926111 | 5/1982 | U.S.S.R. | 66/212 |
| 1687671 | 10/1991 | U.S.S.R. | 66/210 |
| 2253862 | 9/1992 | United Kingdom | 66/210 |

OTHER PUBLICATIONS

"Warp Knit Engineering", A. Reisfeld, 1966.

*Primary Examiner*—John J. Calvert
*Attorney, Agent, or Firm*—Omri M. Behr; Matthew J. McDonald

[57] ABSTRACT

An arrangement for driving a warp beam employs a stepless adjustable drive (7) whose coupling element (8) is displaced by a setting member (11). The setting member (11) is controlled-by a computer (10) which provides an input arrangement (17) for the take-up of data of a predetermined thread provision (F); as well as data on the machine, the stepless adjustable drive (7) and the beam (3). The data includes a wind variable size (actual wind number $w_a$), and data characterizing the actual wind circumference ($U_a$). The computer has a calculating segment (18) and an output (19). With such an arrangement, the coupling element (8) can be brought into the correct target position, even before the start of the machine. The computing means can also serve as part of the control arrangement during the running of the machine.

22 Claims, 1 Drawing Sheet

ARRANGEMENT FOR DRIVING A WARP BEAM

BACKGROUND OF THE INVENTION

1. Field of the Invention

The present invention is directed to an arrangement for driving a warp beam from the machine main shaft via a stepless adjustable drive with a displaceable coupling element determining the step-up relationship, wherein a setting means displaces the coupling element in as direction to maintain a predetermined thread provision.

2. Description of Related Art

Arrangements of the foregoing type are used in warp knitting machines, weaving looms and the like, in order to provide a plurality of threads at the same time, wherein the provision speed has a predetermined relationship to the machine speed. Herein the rate of rotation of the warp beam must increase with decreasing wind diameter in order to maintain this provision speed.

Drive arrangements of the prior art have been described by Reisfeld, Warp Knit Engineering, 1966, pp. 291–294. These have a worm drive driveable by a cog wheel as setting arrangement for the coupling element of the stepless adjustable drive, which is constructed in the form of a bevel gear. The cog wheel is displaced in one direction or the other by ratchets, which are activated by a mechanical comparison arrangement. It has a target value input which is connected with the input shaft of the bevel gear and an actual value input which is connected with a contact roller on the wind upper surface and displaces the coupling element when the actual and target value deviate from one another.

The use of such a stepless adjustable drive has the advantage that a plurality a warp beams of one machine may be driven by its main shaft. For many applications however the contact roller is not useful since it damages the thread material or because slippage occurs. Furthermore, the use of a contact roller requires substantial effort to build and finance. Since the coupling element only finds its correct position after a control action and this occurs rather slowly, the initial segment of the fabric run contains errors and therefore represents losses in production.

U.S. Pat. No. 4,426,856 discloses a warp beam driven by a motor whose rate of rotation is controllable. The appropriate control arrangement comprises a computer which calculates measuring variables dependent from the length of the rolled on or rolled off threads from several beam data, such as wind diameter and thickness of the wind layer, as well as the angle of rotation of the beam. Then the target rate of rotation of the warp beam drive is calculated from the measuring variable, a signal characterizing the angle of rotation of the main shaft, and a setting value, and a corresponding rotational signal is transmitted to a regulator for controlling the warp beam drive. This requires that each beam is provided with a drive motor.

Therefore an object of the present invention is to provide a stepless adjustable drive, equipped with a drive arrangement of the previously described type, which better serves present needs.

SUMMARY OF THE INVENTION

In accordance with the illustrative embodiments demonstrating features and advantages of the present invention, there is provided an arrangement for driving a warp beam from a main shaft of a machine via a stepless adjustable drive having a displaceable coupling element affecting a step-up relationship. This arrangement includes a setting means for displacing the coupling element in a direction for maintaining a predetermined thread provision rate. The setting means comprises a setting member having a control input and adapted to adjust the coupling element. This setting member is operable to adjust the coupling element in response to signals applied to the control input. The arrangement also includes a computing means having an input arrangement and a calculating segment. The input arrangement can receive data signifying a prescribed thread provision rate as well as predetermined operating parameters of: the machine, the stepless adjustable drive and the beam, which include a winding variable related to actual wind diameter. The calculating segment can calculate the desired position of the coupling element from values received by the input arrangement to produce a signal output signifying an appropriate position signal for the setting member.

By employing apparatus of the foregoing type, an improved setting means is achieved. This setting means uses a setting member and a computer having an input arrangement. The input is for data prescribing a thread provision as well as data regarding the machine, the stepless adjustable drive and the beam. The input data includes a wind variable characterizing the actual wind circumference. A calculating portion of the computer calculates, from the input values, the target position of the coupling arrangement. The computer also produces a signal output, which provides the appropriate position signal to the setting member.

This construction enables the target position of the coupling element to be calculated with greater precision. This is possible because the data of the stepless adjustable drive delivered to the input arrangement, together with the remaining inputted data, can be mathematically processed.

Since the calculation of the target position is independent of the running of the machine, a preferred embodiment positions the setting member and the coupling element in the calculated target position while the machine is at rest. Since the coupling element already has the correct position at the start-up of the machine, the initial segment of the goods is not lost, but can be worked from the beginning in an error-free manner.

Another advantageous embodiment has means for the automatic determination input of the wind variable. Here, the computer in the running machine, serves as part of the control arrangement of the coupling element, whose determined target position is altered in dependence upon the change in the wind size. The exactness of the calculation of the target position and the close connection between this target position and the output rate of rotation of the stepless adjustable drive permits good work results to be obtained without a comparison of target and actual values. In particular, one is enabled to operate without a contact roller.

A further alternative has means for the automatic determination and input of the run variable characterizing the actual thread speed. The calculator, during the running of the machine, is part of a regulating arrangement for the coupling element. This regulated coupling element is adjustable in dependence upon the deviation from the target thread speed or a comparable variable. Herein, the calculator determines the target position before the start of the machine, and is utilized during the run, to determine the setting of the coupling element through a regulating procedure.

It is particularly advantageous if the setting member is an electrical stepping motor and the position signal is a stepping signal. Since the setting region of the stepless adjustable drive can be divided into a very large number of very small steps, it is possible to adjust the position of the coupling element exceedingly precisely.

In a preferred adjusting routine, the stepping motor, before the first run-up to the target position, runs up to the reference point first. Thus, whatever disturbing influences occurred during the stationary phase of the machine are minimized in this manner.

Of particular interest as input data for the machine are the step-ups of the gears between the main shaft and the stepless adjustable drive. Step-up or step-up relationship refers to a rate increase accomplished by the input to output ratio of gearing or other mechanisms in a drive train located between a main shaft and the warp beam. The step-up of the gearing and the stepless adjustable drive are chosen to keep a constant ratio between the linear velocity of the warp and the machine speed. In case further gears are provided between the stepless adjustable drive and the warp beam, also their step-ups are part of the machine data. These gears are normally fixed transmission ratio gears, changeover gears and interchangeable gears.

As suitable input data for the stepless adjustable gears are preferably the maximum and minimum step-ups and the appropriate maximum number of steps to run through the thus defined setting region. A calculated actual number of steps determines the position of the coupling element.

It is also advantageous for the computer to have a gauging routine wherein the maximal and minimal step-ups as well as the maximum number of steps are automatically measured and inputted. The gauging of the stepless adjustable drive thus results with the help of the computer.

Also useful as input are the beam data, namely the inner circumference, the outer circumference, the maximum number of winds and the actual number of winds. Naturally, these data are also available in different forms, for example, as diameter, thread thickness, and the like.

Furthermore, the actual wind number must be continually updated. This can occur automatically, for example, with the assistance of sensors provided to the beam, which generate a pulse at each rotation, which alters the actual wind count automatically.

The computer can also assume other functions when it provides a suggestion routine which, based upon the predetermined thread provision, indicates the appropriate step-up data to the machine and thus calculates and indicates the permissible variation region of the thread provision. During the set-up of the machine it is only necessary to provide the data of the beam and the stepless adjustable drive, as well as thread provision. Thereafter the computer will determine the change steps of the changeover gear, the wheel choice of the interchangeable gear and the like. There is also indicated in which range the thread through-put can be varied within these step-up data.

BRIEF DESCRIPTION OF THE DRAWINGS

The above brief description, as well as other objects, features and advantages of the present invention will be more fully appreciated by reference to the following detailed description of presently preferred but nonetheless illustrative embodiments in accordance with the present invention, when taken in conjunction with the accompanying drawings, wherein.

DETAILED DESCRIPTION OF THE PREFERRED EMBODIMENTS

Figure 1:
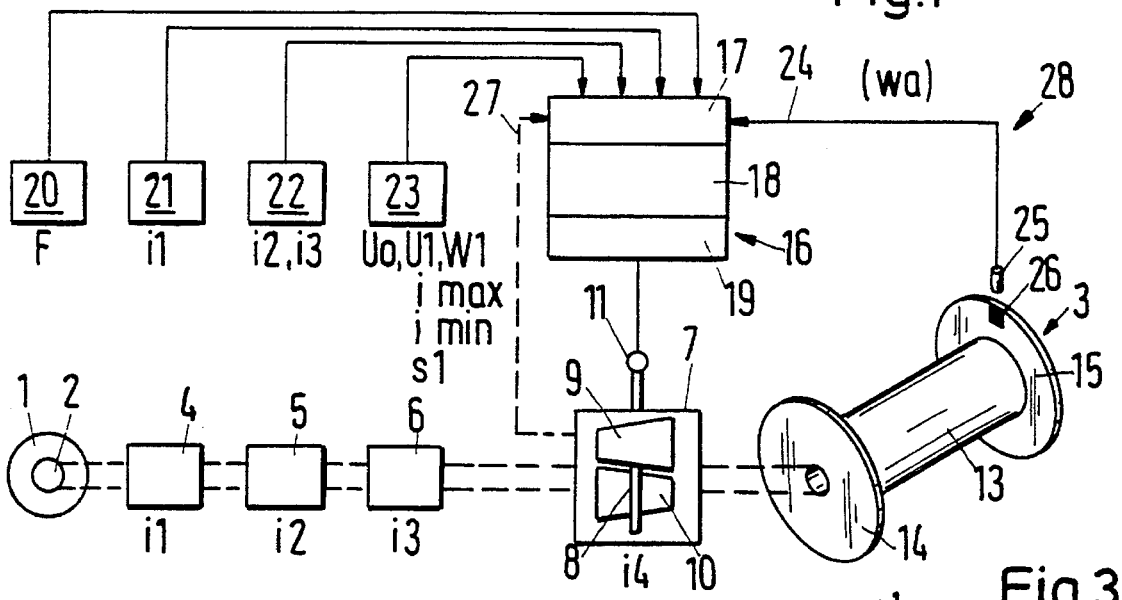
FIG. 1 is a schematic representation of the drive arrangement of the present invention.
Figure 2:
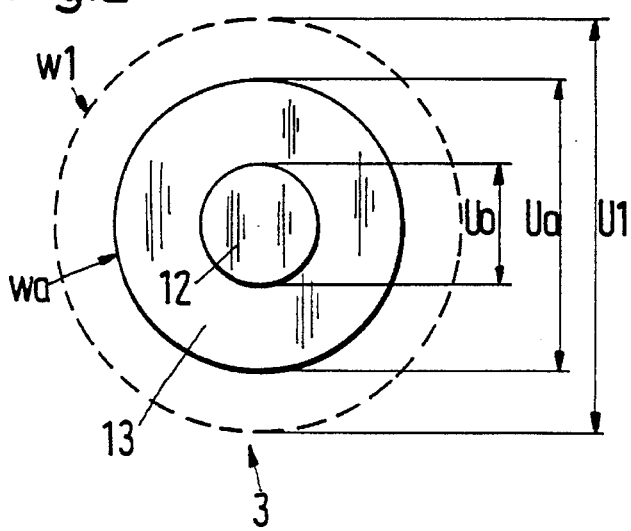
FIG. 2 is a side elevational view of the warp beam wind.
Figure 3:
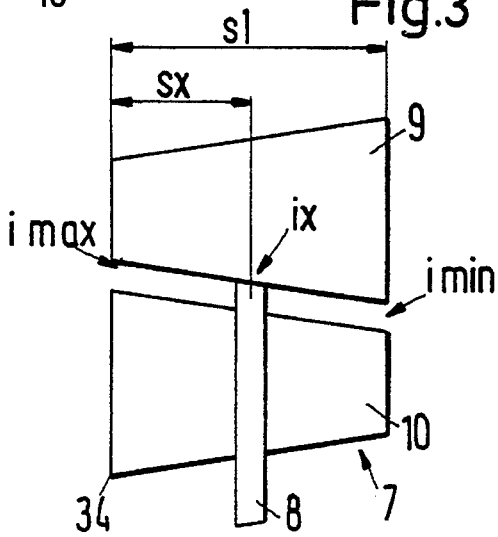
FIG. 3 is a side elevational view of a stepless adjustable drive in the form of a bevel gear.

Referring to FIGS. 1–3, a warp knitting machine comprises a main motor (1), which drives the machine main shaft (2) and at least one warp beam (3). This beam is driven by the main shaft (2) over gearing with fixed transmission ratio gearing (4), changeover gearing (5), an inter-changeable gearing (6) and a stepless adjustable drive (7), the latter illustrated here as a bevel gear. This drive (7) is stepless since the ratio of input to output revolutions is adjustable continuously. The fixed transmission gearing (4) has a fixed step up (speed-increasing gear ratio). The changeover gearing (5) comprises at least two changing steps and thus at least two step up relationships ($i_2$). The interchangeable gearing (6) comprises several step-ups ($i_3$) which depend upon the arrangement of the change wheels.

The stepless adjustable drive (7) has a variable step-up relationship ($i_4$), which depends upon the position of an annular coupling element (8) between the two bevels (9 and 10). Element (8) can translate axially to continuously change the effective meshing locus of the bevel gears 9, 10, thus changing their effective gear ratio. In FIG. 1, the desired axial position for a particular step up ($i_x$) is indicated by the displacement ($s_x$). Where coupling element (8) runs through the entire displacement length ($s_1$), the step-up changes from a maximum value ($i_{max}$) to a minimal value ($i_{min}$).

The coupling element (8) is displaced by setting member (11) containing in this embodiment a stepping motor. The stepping increments can be chosen to be exceedingly small so that an precise and practically stepless setting of the coupling element (8) is possible. For example, the total displacement length ($s_1$) can be divided up in several ten thousands of steps. The values ($s_x$) and ($s_1$) correspond therefore to a definite step number.

In FIGS. 1 and 2, the driven warp beam (3) carries a thread wind (13) on its core (12), which is bordered at the beam ends by each of flanges (14, 15). FIG. 2 illustrates a beam that when full has a wind (13) with ($w_1$) turns or windings. As a consequence of the thread take-off, the wind number was actually reduced to ($w_a$). Thus at the same time, the outer circumference of the wind is reduced as is shown in FIG. 2 by the circumferentially proportional diameters. The actual outer circumference ($U_a$) changes from a value ($U_1$) for a full beam to the value ($U_0$) when the core is reached, that is to say, the actual inner circumference of the original wind (13).

The computing means (16) may be a digital computer in the form of a microprocessor having memory and input/output ports adequate for the functions described herein. Computer (16) comprises an input arrangement (17), a calculating segment (18) and an output (19). Output (19) applies to a control input of setting member (11) a position signal. In this embodiment member (11) is a stepping motor that receives a step signal on its control input.

Input arrangement (17) has a plurality of inputs (20 through 23). Input (20) receives a predetermined thread provision parameter (F). Parameter (F) defines what thread length should be provided for each work cycle of the warp knitting machine. Parameter (F) is generally designated in terms of millimeters/rack (480 stitches equals one rack).

Some of the inputs receive predetermined operating parameters of the knitting machine. For example, input (21) acquires constant machine data; for example, the step-up ratio ($i_1$) of the fixed transmission gearing (4). The input (22) acquires alterable machine data, i.e., setup data. For example, input 22 may receive the changeover step of the change gearing (5) (and thus its step-up, $i_2$), and the arrangement of the gears of the interchangeable gearing (6), i.e., the step-up ($i_3$). The input (23) acquires beam data such as the inner circumference ($U_0$), the outer circumference ($U_1$), and the maximum wind number ($w_1$).

A further input (24) is connected with a sensor means (25). At each passage of a mark (26) on flange (15) of warp beam (3), sensor means (25) generates a pulse which signifies reduction of the number of windings by one. Starting from the maximum wind number ($w_1$) the computing means (16) can determine the exact winding number ($w_a$).

Another input (27) acquires data from the stepless adjustable drive (7), in particular the maximum step-up ($i_{max}$), the minimal step-up ($i_{min}$) and the total number of steps needed for passage through the thus defined displacement region. Since these data are already provided by the manufacturer and can readily be determined by a gauging routine of the computing means (described hereinafter), the input (27) is indicated in phantom as a non-measured input.

From these input data the computing segment (11) can determine the desired position ($s_x$) of the coupling element (8). This occurs as follows: Initially calculations are made in accordance with formula (1) of the actual outer circumference ($U_a$) of the wind.

$$U_a=(U_1-U_0)\cdot(W_a/W_1)+U_0 \quad (1)$$

$U_a$ Actual circumference $U_0$ Inner circumference of the wind $U_1$ Outer circumference of the full beam $w_a$ Actual winding number $w_1$ Winding number of the full beam Knowing the actual value of the outer circumference $U_a$ in accordance with Formula 1, the desired value ($i_x$) of the step-up ($i_4$) of the stepless adjustable drive can be calculated as follows:

$$i_x=\frac{U_a\cdot 480}{F\cdot i_1\cdot i_2\cdot i_3} \quad (2)$$

$i_x$ Desired value of step-up ($i_1$) of the stepless adjustable drive $U_a$ Actual outer circumference $i_1$, $i_2$, $i_3$ Step-ups F Thread provision in millimeters/rack 480 Measuring basis for F (1 rack=480 stitches)

With a knowledge of ($i_x$) one may utilize formula 3 to determine the necessary number of steps for the desired position signal ($s_x$).

$$s_x=s_1\cdot\frac{i_{min}-i_x}{i_x+1}\cdot\frac{i_{max}+1}{i_{min}-i_{max}} \quad (3)$$

$s_x$ Step number for target position $s_1$ Step number for the whole displacement region $i_x$ Target value to step-up $i_4$ of the stepless adjustable drive $i_{min}$ Minimum value of step-up $i_4$ $i_{max}$ Maximum value of step-up $i_4$ Formula 3 takes into account the non-linear relationship between sx and ix in drive (7). In each of the above formulas a plurality of values can be combined to yield a common constant which reduces the calculation work and time.

Therefore, computing means (16) provides a part of the control arrangement (28) which from the input data, determines the target position of coupling element (8). Since the calculation can already take place before the start-up of the machine, coupling element (8) can be brought into the correct position before the machine starts, so that the finished goods are error-free from the start.

When the wind of the warp beam is wound linearly, this type of control is sufficient to permit the coupling element (8) to be brought into the correct position even during running of the machine. With the assistance of sensors (25), the actual wind number ($w_a$) may be determined and thus the actual wind diameter ($U_a$). Therefore, knowing the step-up relationship ($i_x$), the actual thread delivery speed is available.

However, one must take into account the possibility that the warp beam is wound with different tensions and therefore linear conditions do not prevail during unwinding. Thus, it is desirable to control the correct position of the coupling element (8) before the start of the machine and then institute a control using the same computing means (16).

Figure 4:
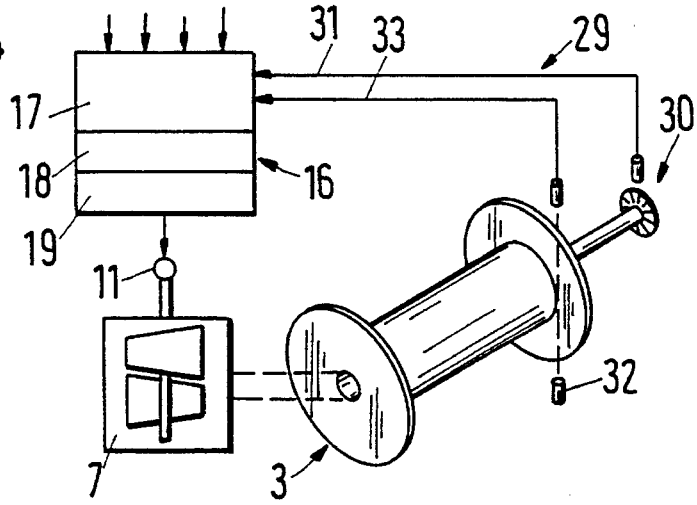
FIG. 4 is a partial view of a modification of FIG. 1.

FIG. 4 illustrates an embodiment in which computing means (16) is part of control arrangement (29). For this purpose warp beam (3) is provided with a rotational angle measuring means (30) which permits the rotational speed of warp beam (3) to be determined and at the same time, takes over the function of sensor (25). Means (3) reads optically or otherwise a plurality of indicia on a disk that rotates in synchronism with beam (3). During the read-off of the indicia, pulses are generated which are provided to input arrangement (17) through input (31).

A diameter measuring means (32) is furthermore available, which, for example, can operate optically and provide the measured diameter value through input (33) to input arrangement (17). From the actual diameter and the actual rate of rotation, one can calculate the run variable characteristic of the thread run speed. This then is compared with the appropriate target value. In dependence upon the deviation from the desired value, the coupling element (8) is displaced by setting element (11).

The stepless adjustable drive (7) is provided with a reference point (34) schematically shown at the edge of bevel (10) (11). The computing means (16) has an adjusting routine where before the first activation, the stepper motor of member (11) runs up to the target position of this reference point (34). The thus determined step number leads coupling element (8) directly into the predetermined target position.

In one particular embodiment a stepping motor has steps of 1.8°, driving a spindle with 150 gears. Using a half-step drive, there is thus obtained an displacement region of 60,000 steps.

Within the basic principles of the invention, a large number of embodiments are possible. Thus, the relationship between the desired step-up (ix) and the target position ($s_x$) can be stored in a table, which can be determined by a number of measurements and the intermediate values obtained by interpolation. Furthermore, with the assistance of sensor (25), the number of revolutions of the warp beam can be determined. Rather than the actual thread provision in the control arrangement, with the aid of a diameter measuring arrangement, one may also be able to determine these values through calculation of inputted data. Instead of utilizing the illustrated bevel gears as the stepless adjustable drive, it is possible to utilize other gears such as friction gears, PIV gears, and the like.

We claim:

1. Arrangement for driving a warp beam from a main shaft of a machine via a stepless adjustable drive having a displaceable coupling element for controlling step-up in said stepless adjustable drive, comprising:

a setting means for displacing the coupling element in a direction for maintaining a predetermined thread provision rate, the setting means comprising:

(a) a setting member having a control input and adapted to adjust said coupling element, said setting member being operable to adjust said coupling element in response to signals applied to said control input, and (b) a computing means including: (i) an input arrangement for receiving data signifying a prescribed thread provision rate as well as predetermined operating parameters of the machine, the stepless adjustable drive and the beam, which include a winding variable related to actual wind diameter, and (ii) a calculating segment for calculating the desired position of the coupling element from values received by said input arrangement to produce a signal output signifying an appropriate position signal for the setting member, said computing means being coupled to said setting member to apply said signal output to said control input.

2. Arrangement in accordance with claim 1, wherein the computing means and setting member are operable to set the coupling element to the desired position, calculated when the machine is at rest.

3. Arrangement in accordance with claim 1 comprising:

sensor means for automatically determining the wind variable and providing the wind variable to said computing means, the computing means being coupled and responsive to said sensor means, said computing means being operable together with said setting member, during operation of the machine, to adjust the coupling element toward the desired position, calculated in dependence upon changes in the wind variable.

4. Arrangement in accordance with claim 2 comprising:

measuring means for automatically determining and providing a run variable signifying actual thread speed, the computing means being coupled and responsive to said measuring means, said computing means being operable together with said setting member, during operation of the machine, to adjust the coupling element in dependence upon deviation of the run variable from a target value.

5. Arrangement in accordance with claim 1 wherein the setting member comprises:

an electrical stepping motor, the position signal being a step signal.

6. Arrangement in accordance with claim 3 wherein the setting member comprises:

an electrical stepping motor, the position signal being a step signal.

7. Arrangement in accordance with claim 6 wherein said coupling element is operable to be driven to a reference point, said computing means having an adjusting routine for running the setting motor to drive the coupling element up to the reference point before bringing the coupling element to the target position.

8. Arrangement according to claim 1 comprising:

gearing serially coupled with the main shaft and the stepless adjustable drive, the input arrangement has means for receiving as predetermined operating parameters of the machine, data signifying the step-ups of the gearing.

9. Arrangement according to claim 2 comprising:

gearing serially coupled with the main shaft and the stepless adjustable drive, the input arrangement has means for receiving as predetermined operating parameters of the machine, data signifying the step-ups of the gearing.

10. Arrangement according to claim 3 comprising:

gearing serially coupled with the main shaft and the stepless adjustable drive, the input arrangement has means for receiving as predetermined operating parameters of the machine, data signifying the step-ups of the gearing.

11. Arrangement in accordance with claim 5, wherein the input arrangement has means for receiving as predetermined operating parameters of the stepless adjustable drive, data signifying maximal step-up, minimal step-up, and the total number of increments for stepping between the maximal and the minimal step-up.

12. Arrangement in accordance with claim 7 wherein the input arrangement has means for receiving as predetermined operating parameters of the stepless adjustable drive, data signifying maximal step-up, minimal step-up, and the total number of increments for stepping between the maximal and the minimal step-up.

13. Arrangement in accordance with claim 11 wherein the computing means has a gauging routine for automatically measuring and inputting the maximal and the minimal step-ups as well as the total number of increments for stepping between the maximal and the minimal step-up.

14. Arrangement in accordance with claim 1, wherein the input arrangement has means for receiving as predetermined operating parameters of the beam, data signifying the beam's: inner circumference, outer circumference, maximum number of windings, and actual number of windings.

15. Arrangement in accordance with claim 3, wherein the input arrangement has means for receiving as predetermined operating parameters of the beam, data signifying the beam's: inner circumference, outer circumference, maximum number of windings, and actual number of windings.

16. Arrangement in accordance with claim 4, wherein the input arrangement has means for receiving as predetermined operating parameters of the beam, data signifying the beam's: inner circumference, outer circumference, maximum number of windings, and actual number of windings.

17. Arrangement in accordance with claim 11, wherein the input arrangement has means for receiving as predetermined operating parameters of the beam, data signifying the beam's: inner circumference, outer circumference, maximum number of windings, and actual number of windings.

18. Arrangement in accordance with claim 13 wherein the input arrangement has means for receiving as predetermined operating parameters of the beam, data signifying the beam's: inner circumference, outer circumference, maximum number of windings, and actual number of windings.

19. Arrangement in accordance with claim 15 the sensor means is coupled to said beam for providing a pulse with each revolution of the beam for the purpose of automatically updating in said input arrangement the actual number of windings.

20. Arrangement in accordance with claim 1, wherein the computing means has, based upon the prescribed thread provision rate, a suggestion routine for (a) indicating appropriate step up data of the machine, and (b) calculating and indicating permissible variations of actual thread provision rate.

21. Arrangement in accordance with claim 3 wherein the computing means has, based upon the prescribed thread provision rate, a suggestion routine for (a) indicating appropriate step up data of the machine, and (b) calculating and indicating permissible variations of actual thread provision rate.

22. Arrangement in accordance with claim 7 wherein the computing means has, based upon the prescribed thread provision rate, a suggestion routine for (a) indicating appropriate step up data of the machine, and (b) calculating and indicating permissible variations of actual thread provision rate.

* * * * *